US011814266B2

(12) United States Patent
Nichols et al.

(10) Patent No.: US 11,814,266 B2
(45) Date of Patent: Nov. 14, 2023

(54) SELF-CLIMBING SELF-LOCKING ELEVATOR

(71) Applicant: OTIS ELEVATOR COMPANY, Farmington, CT (US)

(72) Inventors: Stephen Richard Nichols, Plantsville, CT (US); Tadeusz Pawel Witczak, Farmington, CT (US); John-Paul Clarke, Atlanta, GA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 124 days.

(21) Appl. No.: 17/008,695

(22) Filed: Sep. 1, 2020

(65) Prior Publication Data

US 2022/0063959 A1 Mar. 3, 2022

(51) Int. Cl.

| | |
|---|---|
| ***B66B 9/02*** | (2006.01) |
| ***B66B 1/02*** | (2006.01) |
| ***B66B 7/04*** | (2006.01) |
| ***B66B 9/04*** | (2006.01) |
| ***B66B 11/02*** | (2006.01) |
| ***B66B 11/04*** | (2006.01) |
| *E04G 3/28* | (2006.01) |

(52) U.S. Cl.

CPC ..... *B66B 9/02* (2013.01); *B66B 1/02* (2013.01); *B66B 7/046* (2013.01); *B66B 9/04* (2013.01); *B66B 11/02* (2013.01); *B66B 11/0423* (2013.01); *E04G 2003/286* (2013.01)

(58) Field of Classification Search

CPC ..... B66B 9/02; B66B 9/027; E04G 3/246; E04G 3/28; E04G 2003/286; E04G 21/3247; F03D 80/50

See application file for complete search history.

(56) References Cited

U.S. PATENT DOCUMENTS

| | | | | |
|---|---|---|---|---|
| 4,660,678 A * | 4/1987 | Krag | ..... | E04G 3/28 182/63.1 |
| 5,464,072 A * | 11/1995 | Muller | ..... | B66B 9/02 182/12 |
| 5,579,865 A * | 12/1996 | Butler | ..... | E04G 1/20 182/141 |
| 9,410,329 B2 * | 8/2016 | Keersmaekers | ..... | E04G 1/18 |

(Continued)

FOREIGN PATENT DOCUMENTS

| | | |
|---|---|---|
| CN | 109399432 A | 3/2019 |
| WO | 2020/142001 A1 | 7/2020 |

OTHER PUBLICATIONS

Extended European Search Report for Application No. EP 21 19 4399 dated Dec. 16, 2021.

*Primary Examiner* — Minh Truong

(74) *Attorney, Agent, or Firm* — Carlson, Gaskey & Olds, P.C.

(57) ABSTRACT

An illustrative example embodiment of an elevator system includes a platform and a plurality of supports configured to selectively engage a nearby structure. The plurality of supports include at least a first support and a second support. The first and second supports alternate between engaging the nearby structure to support the platform while the other one of the supports is disengaged from the nearby structure. At least one of the first and second supports is configured to move relative to the platform while engaging the nearby structure to cause vertical movement of the platform.

13 Claims, 4 Drawing Sheets

(56) References Cited

U.S. PATENT DOCUMENTS

| | | | | |
|---|---|---|---|---|
| 10,494,235 | B2 * | 12/2019 | Nelson | B66C 23/207 |
| 2009/0020361 | A1 * | 1/2009 | Teichert | F03D 80/50 182/36 |
| 2013/0043094 | A1 * | 2/2013 | Lee | F03D 80/50 182/136 |
| 2015/0107186 | A1 * | 4/2015 | Wilts | B66B 19/002 52/741.1 |
| 2020/0332539 | A1 * | 10/2020 | Deifel | E04G 11/28 |

* cited by examiner

SELF-CLIMBING SELF-LOCKING ELEVATOR

BACKGROUND

Elevator systems are useful for carrying passengers and items between different levels of a building. Many elevator systems are traction-based and include traction ropes that suspend the elevator car and a counterweight. A machine causes movement of a traction sheave that, in turn, causes movement of the traction ropes for moving the elevator car as desired. Other elevator systems are hydraulic and include an expanding cylinder that raises or lowers the elevator car.

Each type of elevator system has limitations. For example, the ropes of traction-based systems introduce significant weight and expense in high-rise building installations. The traction ropes may also experience sway under various conditions. One limitation on hydraulic elevator systems is that they are not practical for high rise buildings.

Elevator system providers are always striving to increase the efficiencies and economies of elevator systems. For example, various proposals have been made to include more than one elevator car in a single hoistway to increase the passenger-carrying capacity while occupying less building space. Such proposals are often considered too complicated and have not been widely adopted.

SUMMARY

An illustrative example embodiment of an elevator system includes a platform and a plurality of supports configured to selectively engage a nearby structure. The plurality of supports include at least a first support and a second support. The first and second supports alternate between engaging the nearby structure to support the platform while the other one of the supports is disengaged from the nearby structure. At least one of the first and second supports is configured to move relative to the platform while engaging the nearby structure to cause vertical movement of the platform.

In an example embodiment having at least one feature of the elevator system of the previous paragraph, at least one of the first and second supports extends or contracts while engaging the nearby structure to cause the vertical movement of the platform.

In an example embodiment having at least one feature of the elevator system of any of the previous paragraphs, each of the supports has a vertical stroke corresponding to a distance between a fully contracted position and a fully extended position of the support, and both of the first and second supports simultaneously engage the nearby structure while extending or contracting along at least a portion of the vertical stroke of the support such that both of the first and second supports simultaneously cause the vertical movement of the platform.

In an example embodiment having at least one feature of the elevator system of any of the previous paragraphs, the first support extends over the portion of the vertical stroke, and the second support contracts over the portion of the vertical stroke.

In an example embodiment having at least one feature of the elevator system of any of the previous paragraphs, one of the first and second supports engages the nearby structure while extending or contracting along another portion of the vertical stroke of the support simultaneously with the other of the second and first supports contracting or extending along another portion of the vertical stroke of the support while being disengaged from the nearby structure.

In an example embodiment having at least one feature of the elevator system of any of the previous paragraphs, at least some of the supports each comprise an articulating robotic arm.

In an example embodiment having at least one feature of the elevator system of any of the previous paragraphs, at least some of the supports each comprise a pressurized cylinder.

In an example embodiment having at least one feature of the elevator system of any of the previous paragraphs, the supports each comprise a grip near one end of the support configured to engage the nearby structure.

In an example embodiment having at least one feature of the elevator system of any of the previous paragraphs, the grips are respectively configured to engage at least one type of feature selected from the group of features consisting of a wall, a pole, a rail, a rope, a belt, a rung, a groove, a flange, a tooth and a rib.

In an example embodiment having at least one feature of the elevator system of any of the previous paragraphs, the first support is situated relative to the platform for extending above the platform, and the second support is situated relative to the platform for extending beneath the platform.

In an example embodiment having at least one feature of the elevator system of any of the previous paragraphs, the first and second supports each engage the nearby structure adjacent a first side of the platform, and the platform includes at least one follower on a second side of the platform that is configured to follow along a nearby structure adjacent the second side of the platform.

In an example embodiment having at least one feature of the elevator system of any of the previous paragraphs, the at least one follower comprises a plurality of rollers.

In an example embodiment having at least one feature of the elevator system of any of the previous paragraphs, the plurality of supports includes at least two of the supports situated relative to the platform for extending above the platform and at least two others of the supports situated relative to the platform for extending beneath the platform.

In an example embodiment having at least one feature of the elevator system of any of the previous paragraphs, the platform is part of an elevator car including a cabin configured to accommodate a plurality of passengers.

An illustrative example embodiment of a method of controlling movement of an elevator platform includes: selectively engaging a nearby structure using supports associated with the platform, alternating between engaging the nearby structure using at least a first one of the supports or at least a second one of the supports to support the platform while the other one of the supports is disengaged from the nearby structure, and moving at least one of the first and second supports relative to the platform while engaging the nearby structure to cause vertical movement of the platform.

In an example embodiment having at least one feature of the method of the previous paragraph, the moving comprises extending or contracting the at least one of the first and second supports while engaging the nearby structure to cause the vertical movement of the platform.

In an example embodiment having at least one feature of the method of any of the previous paragraphs, each of the supports has a vertical stroke corresponding to a distance between a fully contracted position and a fully extended position of the support, and the method comprises simultaneously engaging the nearby structure while extending or contracting both of the first and second supports along at least a portion of the vertical stroke of the support such that both of the first and second one of the supports simultaneously cause the vertical movement of the platform.

An example embodiment having at least one feature of the method of any of the previous paragraphs includes extending the first one of the supports over the portion of the vertical stroke simultaneously with contracting the second one of the supports over the portion of the vertical stroke.

An example embodiment having at least one feature of the method of any of the previous paragraphs includes engaging the nearby structure by one of the first and second supports while extending or contracting along another portion of the vertical stroke of the support simultaneously with disengaging the other of the second and first supports from the nearby structure while contracting or extending the support along another portion of the vertical stroke of the support.

An example embodiment having at least one feature of the method of any of the previous paragraphs includes extending the first one of the supports above the platform, and extending the second one of the supports beneath the platform.

The various features and advantages of at least one disclosed example embodiment will become apparent to those skilled in the art from the following detailed description. The drawings that accompany the detailed description can be briefly described as follows.

DETAILED DESCRIPTION

Figure 1:
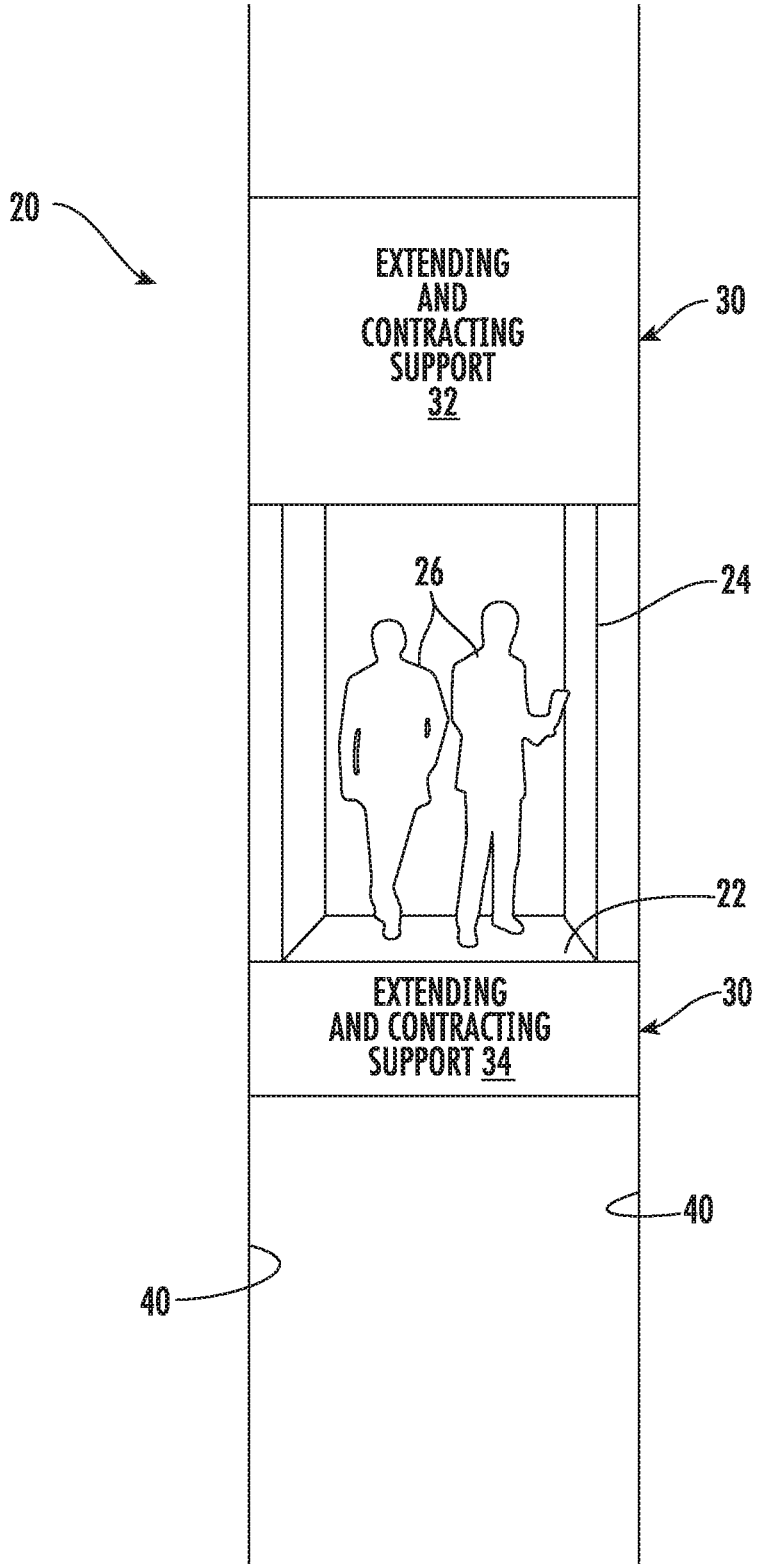
FIG. 1 schematically illustrates selected portions of an elevator system.

FIG. 1 schematically illustrates selected portions of an elevator system 20. A platform 22 is part of an elevator car 24 that includes a cabin configured to accommodate a plurality of passengers 26.

A plurality of supports 30 are configured to move relative to the platform in a manner that causes vertical movement of the platform 22. In the example of FIG. 1, a first support 32 is situated above the platform 22 and a second support 34 is situated beneath the platform 22. The plurality of supports 30 provide stability and support for the platform 22 and selectively cause vertical movement of the platform 22 in a manner that introduces various efficiencies and design opportunities within an elevator system.

The plurality of supports 30 are configured to sequentially and alternately engage a nearby structure 40 and to extend or contract to cause vertical movement of the platform 22. The first support 32 and the second support 34 sequentially alternate between engaging the nearby structure 40 to support the platform 22 while the other support is disengaged from the nearby structure 40. At least the one of the supports 30 that engages the nearby structure 40 moves relative to the platform 22 to cause vertical movement of the platform 22. In this example embodiment, the movement of the supports 30 relative to the platform 22 includes extending and contracting. The first support 32 is schematically shown in an extended position or condition while the second support 34 is schematically illustrated in a contracted position or condition.

Figure 2:
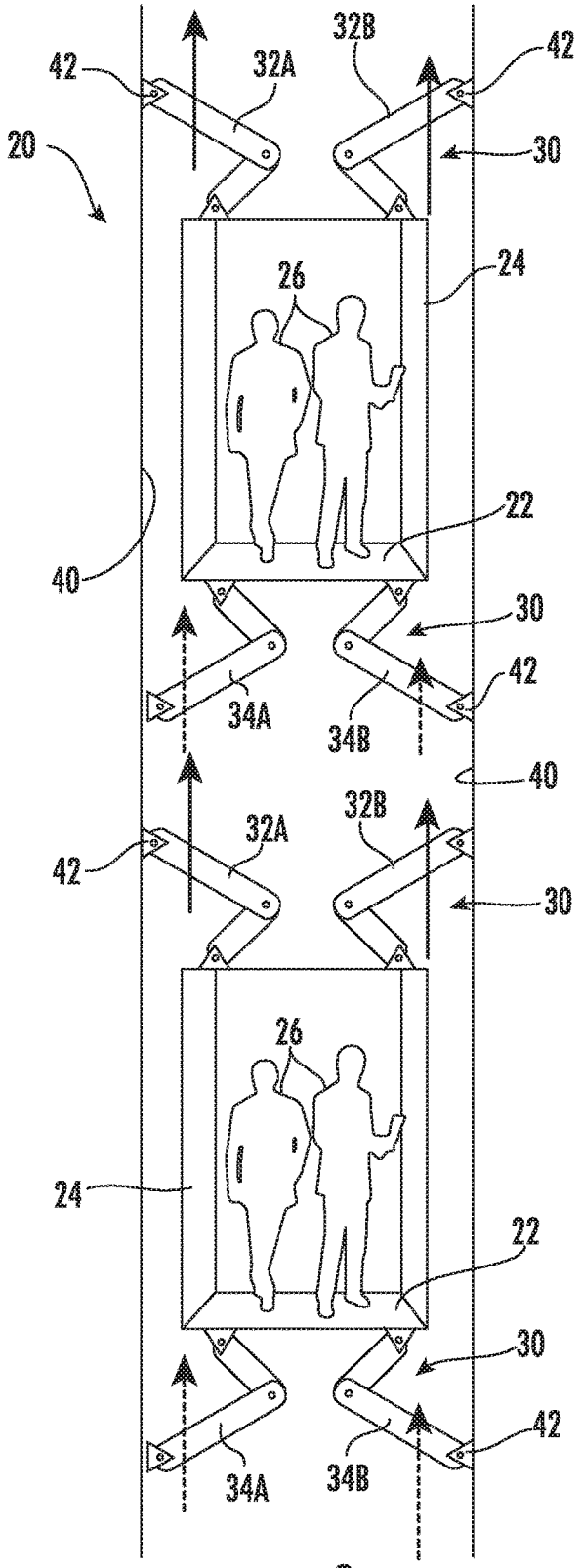
FIG. 2 schematically illustrates selected portions of an example elevator system that includes multiple cars in a single hoistway.

FIG. 2 illustrates one example arrangement of an elevator system 20 that includes multiple platforms 22 within a single hoistway. In this example, each platform 22 is like that shown in FIG. 1 and part of an elevator car 24. The plurality of supports 30 includes first supports 32A and 32B situated to extend above the elevator car 24. Second supports 34A and 34B are situated for extending beneath the elevator car 24. Each of the supports includes a gripper 42 configured to engage the nearby structure 40, which includes the interior hoistway walls in this example.

The supports 30 in the illustrated example embodiment each comprise an articulated robotic arm. Coordinated extending and contracting movement of the robotic arm supports 30 achieves desired vertical movement of the elevator car 24 as the first supports 32A and 32B and the second supports 34A and 34B sequentially alternate between engaging the hoistway walls 40 to support the platform 22 while the other supports are disengaged from the hoistway walls 40. For example, the first supports 32A and 32B may first be extended above the elevator car 24 and engage the hoistway walls 40. The second supports 34A and 34B may then disengage from the hoistway walls 40 and contract upward toward the platform 22. At the same time, the first supports 32A and 32B contract, pulling the elevator car 24 vertically upward. At some point the second supports 34A and 34B engage the hoistway walls 40 and then extend, further propelling the elevator car 24 vertically upward. While the second supports 34A and 34B are engaged with the hoistway walls 40, the first supports 34A and 34B can disengage and extend again above the elevator car 24. Such sequential and alternating engagement and disengagement from the nearby structure 40 while extending or contracting, allows the supports 30 to secure the platform 22 against undesired movement and achieve the desired vertical movement.

Different coordinated movements are possible among the plurality of supports 30 associated with each platform 22 to achieve desired support of the platform 22 and a desired speed of vertical movement. For example, each of the supports 30 has a vertical stroke corresponding to a distance between a fully contracted position and a fully extended position of the support 30. The first supports 32A and 32B can simultaneously engage the nearby structure 40 while the second supports 34A and 34B also engage the nearby structure 40. All of the first supports 32A, 32B and the second supports 34A, 34B can simultaneously extend or contract along at least a portion of the vertical stroke of the support such that the first supports 32A, 32B and the second supports 34A, 34B simultaneously cause vertical movement of the platform 22. During such motion causing downward movement of the platform 22, the first supports 32A, 32B extend over the portion of the vertical stroke while the second supports 34A, 34B contract over a corresponding portion of their vertical stroke.

In some such embodiments, at least the first supports 32A, 32B or the second supports 34A, 34B engages the nearby structure 40 while extending or contracting along another portion of the vertical stroke of those supports. At the same time, the other of the second supports 34A, 34B or the first supports 32A, 32B contracts or extends along another portion of the vertical stroke of those supports while being disengaged from the nearby structure 40.

A variety of timings are possible between the engagement and disengagement of the supports 30 from the nearby structure 40 and a variety of percentages of the vertical stroke of each support may be used while engaged with the nearby structure 40 to achieve desired movement of the platform 22.

Such coordinated movement can facilitate relatively quick vertical movement of the platform 22 while always having at least some of the supports 30 engaged with the nearby structure 40 to support the platform 22 in a way that controls any vertical movement of the platform.

One feature of the example arrangement shown in FIG. 2 is that multiple elevator cars 24 are independently moveable within a single hoistway. The extending and contracting supports 30 make it possible to incorporate as many elevator cars within a single hoistway as desired without requiring a complicated arrangement of traction ropes, for example. With an elevator system designed according to an embodiment of this invention, it is, at least in some respects, easier to incorporate multiple cars within a single hoistway and to move them independent of each other.

Figure 3:
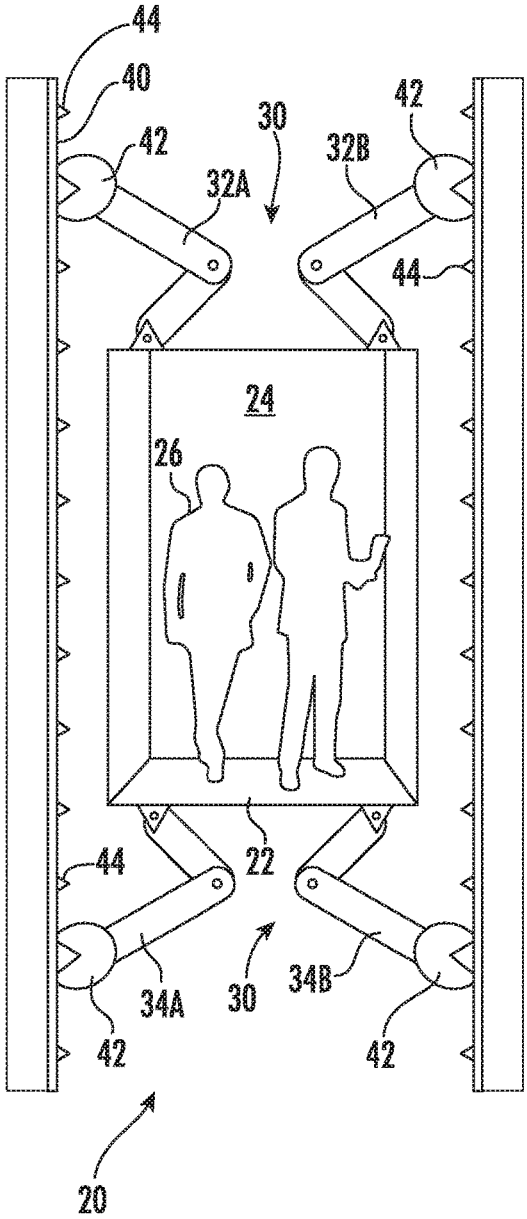
FIG. 3 schematically illustrates selected portions of an elevator system that includes climbing and supporting features within a hoistway.

FIG. 3 illustrates an arrangement in which the nearby structure 40 includes climbing features 44 that the grips 42 engage for purposes of supporting the platform 22 in a desired position and moving the platform 22 when desired. The features 44 may take a variety of forms depending on the particular configuration of the elevator system 20 and the grips 42 are configured in a corresponding manner to facilitate reliable engagement. In some embodiments, the features 44 comprise a plurality of rungs, grooves, or ribs. Such features 44 may be incorporated into or secured to the building structure, such as the interior hoistway walls. In other embodiments, the features 44 are part of a self-standing or self-supporting structure that is situated in a manner that accommodates the loads of the elevator system 20. The grips 42 may include hooks, clamps, or electromagnets, for example, to achieve reliable engagement with the features 44.

Figure 4:
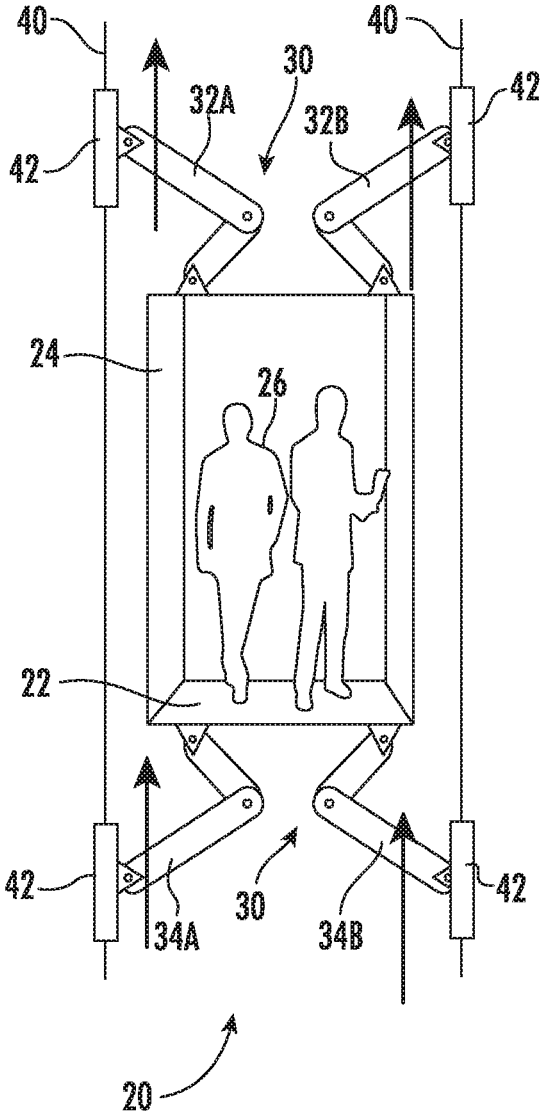
FIG. 4 schematically illustrates selected portions of an elevator system including a climbing structure that may be situated outside of a building or hoistway.

FIG. 4 schematically illustrates another example embodiment in which the elevator system 20 does not require a hoistway. In this example, the nearby structure 40 comprises a plurality of elongate vertical members that are engaged by the grips 42 of the supports 30 for purposes of climbing along the elongate vertical members to achieve the desired vertical movement of the platform 22. Structures 40 in such an embodiment may include a rail, a pole, a rope, or a belt, for example. Such structures may include climbing features 44, such as teeth, flanges, ribs or grooves. Although the nearby structure 40 includes two elongate vertical members as illustrated in FIG. 4, other embodiments include a single pole or rope, for example, that the extending and contracting supports 30 engage.

Figure 5:
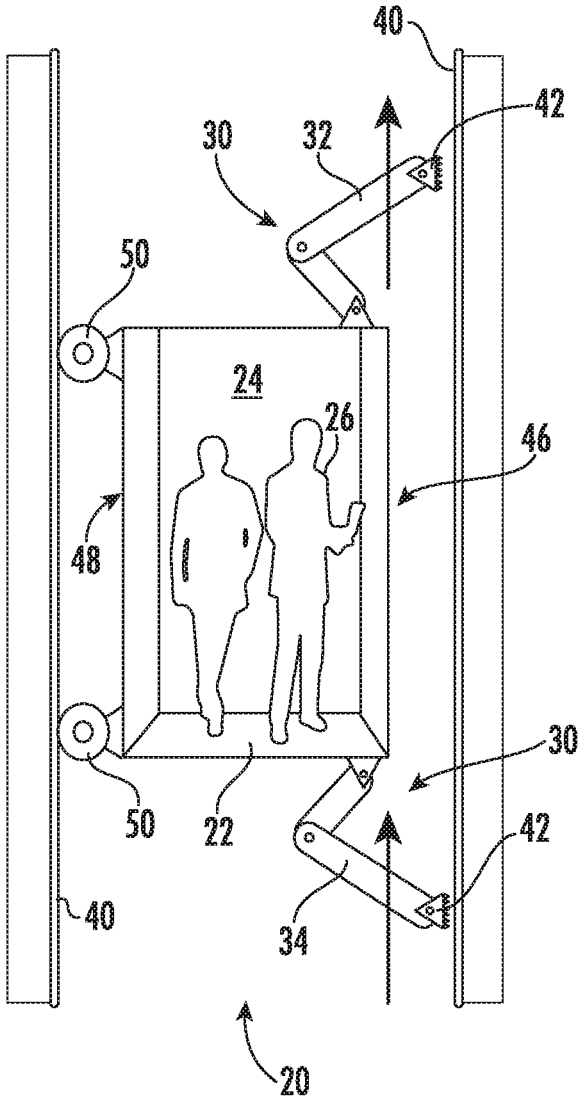
FIG. 5 schematically illustrates selected portions of an elevator system including a structure following mechanism.

FIG. 5 illustrates another example arrangement of an elevator system 20 including extending and contracting supports 30. In this example arrangement, a single first support 32 and a single second support 34 are situated near a first side 46 of the elevator car 24. The grips 42 on the supports 32 and 34 engage a nearby structure 40, such as an interior hoistway wall adjacent the first side 46. In this embodiment, the grips 42 include a friction material configured to frictionally engage the nearby structure 40. At least one follower is situated near an opposite, second side 48 of the elevator car 24. In this example, the follower includes a plurality of rollers 50 that follow along the nearby structure 40 that is adjacent the second side 48 of the elevator car 24. The rollers 50 in some such embodiments follow a channel, groove or vertically extending rib that is part of, or secured to, the hoistway wall 40. Horizontal forces imposed by the supports 30 and frictional engagement with the nearby structure provides the support needed for the platform 22 and allows for accomplishing desired vertical movement.

Figure 6:
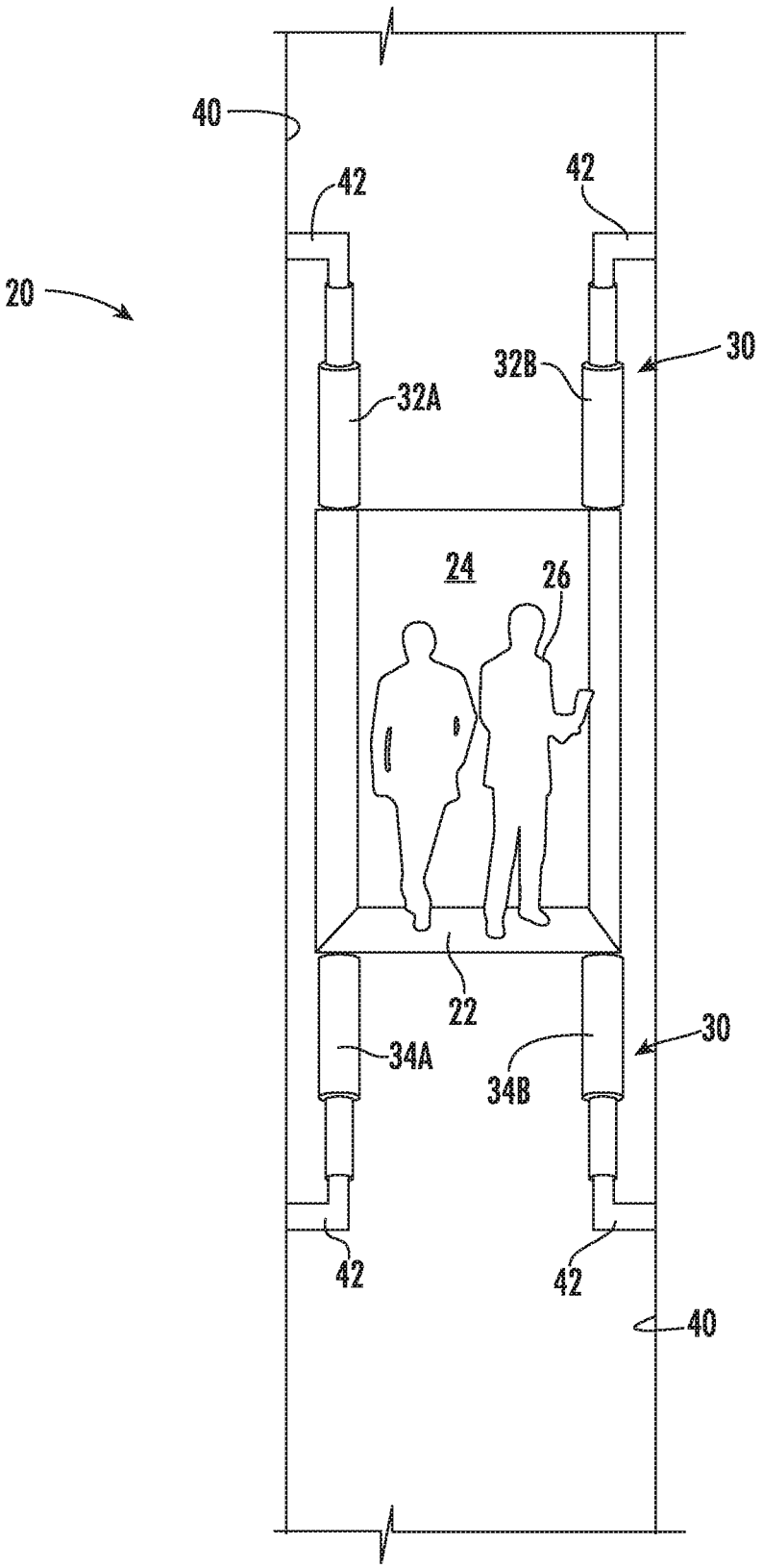
FIG. 6 schematically illustrates selected portions of an elevator system including pressurized cylinders.

FIG. 6 schematically illustrates another example elevator system configuration in which the supports 30 include pressurized cylinders that extend and contract in a sequential and alternating manner that is coordinated to achieve vertical movement of the platform 22. The pressurized cylinders in some embodiments are hydraulic. In other embodiments the pressurized cylinders are pneumatic. The grips 42 in some such embodiments are electromagnetic and engage a metallic surface on the nearby structure 40 when energized. Having grips 42 that are selectively energized to engage the nearby structure 40 allows for the pressurized cylinders of the supports 30 to extend in a vertical direction while selectively engaging or disengaging from the nearby structure 40.

The various elevator system configurations described above and illustrated in the figures have features that are not necessarily limited to just that particular embodiment or configuration. Various other combinations of the individual features of those embodiments are possible to realize still other embodiments. For example, it is possible to utilize vertically extending members 40 like those shown in FIG. 4 with pressurized cylinders like those shown in FIG. 6 and features 44 like those shown in FIG. 3. Other combinations of the illustrated components or variations of them are possible and may become apparent to those skilled in the art who have the benefit of this description.

The platforms 22 in the illustrations are associated with a cabin. Other platform configurations can be used with supports 30 for various purposes in an elevator system. For example, a platform may be configured for installation of elevator system components and used for positioning equipment or workers in a hoistway during installation or maintenance. Other platform configurations are useful for rescue operations to carry an individual along a hoistway into a position to attend to passengers in a car that is stopped in the hoistway. In some such systems, the platform and supports operate independently of the passenger-carrying car of the elevator system.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

an elevator car situated inside a hoistway, the elevator car including a cabin having a floor, solid panel walls having one end adjacent the floor and a ceiling adjacent opposite ends of the solid panel walls, the ceiling covering an entire area spanning between the solid panel walls, and wherein the floor, solid panel walls, and the ceiling of the cabin define an enclosed space configured to accommodate at least one passenger and isolate the at least one passenger from an interior of the hoistway; and a plurality of supports configured to selectively engage a nearby structure inside the hoistway, the plurality of supports including at least a first support and a second support, wherein the first support extends and contracts above the elevator car to cause vertical movement, and the second support extends and contracts beneath the elevator car to cause vertical movement, and the first and second supports alternating between engaging the nearby structure to support the elevator car while another one of the first and second supports is disengaged from the nearby structure, at least one of the first and second supports being configured to move relative to the elevator car while engaging the nearby structure to cause vertical movement of the elevator car.

2. The elevator system of claim 1, wherein the at least one of the first and second supports extends or contracts while engaging the nearby structure to cause the vertical movement of the elevator car.

3. The elevator system of claim 1, wherein at least some of the supports each comprise an articulating robotic arm.

4. The elevator system of claim 1, wherein at least some of the supports each comprise a pressurized cylinder.

5. The elevator system of claim 1, wherein the supports each comprise a grip near one end of the support configured to engage the nearby structure.

6. The elevator system of claim 5, wherein the grips are respectively configured to engage at least one type of feature selected from the group of features consisting of a wall, a pole, a rail, a rope, a belt, a rung, a groove, a flange, a tooth and a rib.

7. The elevator system of claim 1, wherein the first and second supports each engage the nearby structure adjacent a first side of the elevator car, and the elevator car includes at least one follower on a second side of the elevator car that is configured to follow along a nearby structure inside the hoistway adjacent the second side of the elevator car.

8. The elevator system of claim 7, wherein the at least one follower comprises a plurality of rollers.

9. The elevator system of claim 1, wherein the plurality of supports includes at least two of the supports situated relative to the elevator car for extending above the elevator car and at least two others of the supports situated relative to the elevator car for extending beneath the elevator car.

10. The elevator system of claim 1, wherein contracting and extending movement of the first support is coordinated with contracting and extending movement of the second support to achieve a desired support of the elevator car and a desired speed of vertical movement.

11. An elevator system, comprising:

an elevator car situated inside a hoistway, the elevator car including a cabin having a floor, solid panel walls having one end adjacent the floor and a ceiling adjacent opposite ends of the solid panel walls, the ceiling covering an entire area spanning between the solid panel walls, and wherein the floor, the solid panel walls, and the ceiling of the cabin define an enclosed space configured to accommodate at least one passenger and isolate the at least one passenger from an interior of the hoistway; and a plurality of supports configured to selectively engage a nearby structure inside the hoistway, the plurality of supports including at least a first support and a second support, the first and second supports alternating between engaging the nearby structure to support the elevator car while another one of the first and second supports is disengaged from the nearby structure, at least one of the first and second supports being configured to move relative to the elevator car while engaging the nearby structure to cause vertical movement of the elevator car, and wherein the at least one of the first and second supports extends or contracts while engaging the nearby structure to cause the vertical movement of the elevator car, and wherein each of the supports has a vertical stroke corresponding to a distance between a fully contracted position and a fully extended position of the support, and both of the first and second supports simultaneously engage the nearby structure while extending or contracting along at least a portion of the vertical stroke of the support such that both of the first and second supports simultaneously cause the vertical movement of the elevator car.

12. The elevator system of claim 11, wherein the first support extends over the portion of the vertical stroke, and the second support contracts over the portion of the vertical stroke.

13. The elevator system of claim 11, wherein one of the first and second supports engages the nearby structure while extending or contracting along another portion of the vertical stroke of the support simultaneously with the other of the second and first supports contracting or extending along another portion of the vertical stroke of the support while being disengaged from the nearby structure.

* * * * *